United States Patent [19]

Owens, Jr.

[11] 4,245,841

[45] Jan. 20, 1981

[54] GOLF TRAINING DEVICE

[76] Inventor: Fred L. Owens, Jr., 116 Bennett St., Auburndale, Fla. 33823

[21] Appl. No.: 70,000

[22] Filed: Aug. 27, 1979

[51] Int. Cl.[3] ..... A63B 69/36

[52] U.S. Cl. ..... 273/183 B; 273/189 R

[58] Field of Search ..... 273/54 B, 189 R, 189 A, 273/183 B; 35/29 A

[56] References Cited

U.S. PATENT DOCUMENTS

| | | | |
|---|---|---|---|
| 3,350,100 | 10/1967 | Carmines | 273/183 B |
| 3,400,934 | 9/1968 | Muehl | 273/189 R |
| 3,408,077 | 10/1968 | Norwood | 273/189 A |
| 3,419,276 | 12/1968 | Poggioli | 273/183 B |
| 3,606,342 | 9/1971 | Albertson | 273/189 R |
| 3,865,383 | 2/1975 | Clay et al. | 273/183 B |
| 4,017,086 | 4/1977 | Washburn | 273/183 B |
| 4,088,318 | 5/1978 | Massman | 273/189 A |

*Primary Examiner*—George J. Marlo

*Attorney, Agent, or Firm*—Roger L. Martin

[57] ABSTRACT

A golfer's training device is attachable to the forearm part of the arm that leads in the golf swing. It has a pivotal member with a distal end portion that engages the back hand when the pivotal member is in its normal operating position. The pivotal member has a body portion at the proximal end of the member and the distal end portion pivots with respect to the body portion about an axis that is normal to the back of the hand while the whole assembly pivots about an axis that is parallel to the back of the hand. A device for retaining the member in its normal operating position includes an elongated, resilient element that is carried on the pivotal member and which engages a pin that is mounted on a base plate component of the device a slidable structure being provided to adjust the elongated element so as to thereby change the deterring force at which the pivotal member can be caused to move out of its normal position in response to pressure applied to the distal end portion through backward movement of the hand.

8 Claims, 8 Drawing Figures

GOLF TRAINING DEVICE

The invention relates to a golf training device and more particularly to a device which is attached to the forearm of the leading arm during a golfer's swing so as to be useful in training the golfer to uncock the wrist of the power arm at the proper point in the down swing of the club.

The movements of the hand with respect to the forearm in golf swings can generally be viewed as a pivotal hand movement about one or more of two axes through the wrist joint and which are respectively perpendicular and parallel to the back of the hand. During the back swing for most golf shots, the hand of the leading arm primarily pivots about the axis normal to the back of the hand while the hand of the power arm pivots about both axes and into a cocked position at which the hand is bent backwardly about the axis parallel to the back of the hand. This cocked position for the hand of the power arm is normally retained during the down swing and until just prior to the point at which the club head addresses the ball. At this point in the power stroke, the hand of the power arm becomes uncocked and thereafter, as the club follows through after impact with the ball, the hand of the leading arm, which up to this point is only pivoted about the axis normal to the back of the hand, bends back about the axis which is parallel to the back of the hand. If this backward pivotal movement of the hand of the leading arm is premature the accuracy and effectiveness of the shot is normally less than satisfactory for the uncocking of the power hand closely precedes the backward bending of the leading hand.

Many devices have been advocated for attachment to either the leading or power arm in order to prevent premature uncocking of the power hand. Some of the devices are attached to the power arm and during the back swing actually lock the hand in the cocked position. Such devices provide some means for releasing the lock during the power stroke and are usually complicated structures that are not generally found in the marketplace. Such devices do little to train the golfer and instead provide an artifical substitute for the natural timing of the wrist break that is desired during the power stroke.

Still other devices are contemplated for attachment to the leading arm. Here the general approach taken by the advocates is to limit hand movement to a pivotal movement about the axis perpendicular to the back of the hand. In some cases, a locking mechanism is provided to prevent pivotal movement about the axis until a proper point is reached during the power stroke. In other cases, audible means are provided to guide the golfer into the proper wrist movement. Devices of this nature still fail to take into account that the hand of the leading arm pivots backwardly about the axis parallel to the back of the hand during the follow through portion of the power stroke and again are mainly devices that are designed to limit the hand movement as opposed to providing a training aid for the golfer so as to develop his natural athletic skills.

In accord with the instant invention, the golfer is provided with a training device which is attachable to the forearm of the leading arm used for the power stroke. The device is equipped with a pivot arm or member that is arranged to pivot about an axis which is generally parallel to an axis through the wrist joint and which is parallel with the back of the hand. This pivot member has a distal end portion which is arranged to engage the back of the golfer's hand at a base plate overlying or normal operating position for the pivotal member. At this position, the pivotal member is normally restrained from movement out of the position but the restraint can be overcome to release the pivot arm for movement to an offset position by exertion or hand pressure against the distal end portion as during the backward movement of the hand during the follow through portion of the power stroke. The device, while permitting the hand of the leading arm to pivot backwardly during the follow through of the power stroke nevertheless, acts as a deterrant to such movement during the down swing. As such, a user of the device will sense and use the break away or release of the pivot arm during the power swing as an index or reference point for the completion of the proper wrist movements by the power hand. With practice and training the golfer may then develop a natural swing which may be consumated without the aid of the training device.

In accord with certain aspects of the invention, provisions are made for adjusting the pivot member retainer to provide for a greater or lesser pressure deterrent to the release of the pivot member and its movement out of its normal operating position. In accord with other aspects of the invention, the distal end portion of the pivotal member that engages the back of the golfer's hands is articulated to facilitate generally free pivotal movement of the hand about the axis perpendicular to the back of the hand. Other aspects contemplate a novel means for adjustably determining the hand pressure required for release of the pivot arm from its normal operating position.

A general object of the invention is to provide an improved training device for use by golfers in perfecting their golf swing for tee and fairway shots. Yet another object of the invention is to provide a device that is worn on the leading arm during a golf swing and which by sensing backward pivotal movement of the hand serves to train the golfer in the proper timing of the power hand movements. Still another object of the invention is to provide a device that may be used by golfers to improve his power hand movements during his golf swing and without the need for using attachments to the power arm. Yet other objectives are to provide an efficient device of the kind contemplated and which is relatively simple to manufacture and assemble. Other objectives of the invention are to provide a device of the kind contemplated which can be adjusted to accommodate the needs of the user.

The novel features which are believed to be characteristic of this invention are set forth with particularity in the appended claims.

The invention, itself, however, both as to its organization and method of operation, together with further objects and advantages thereof, may best be understood by reference to the following description taken in connection with the accompanying drawings, wherein.

Figure 2:
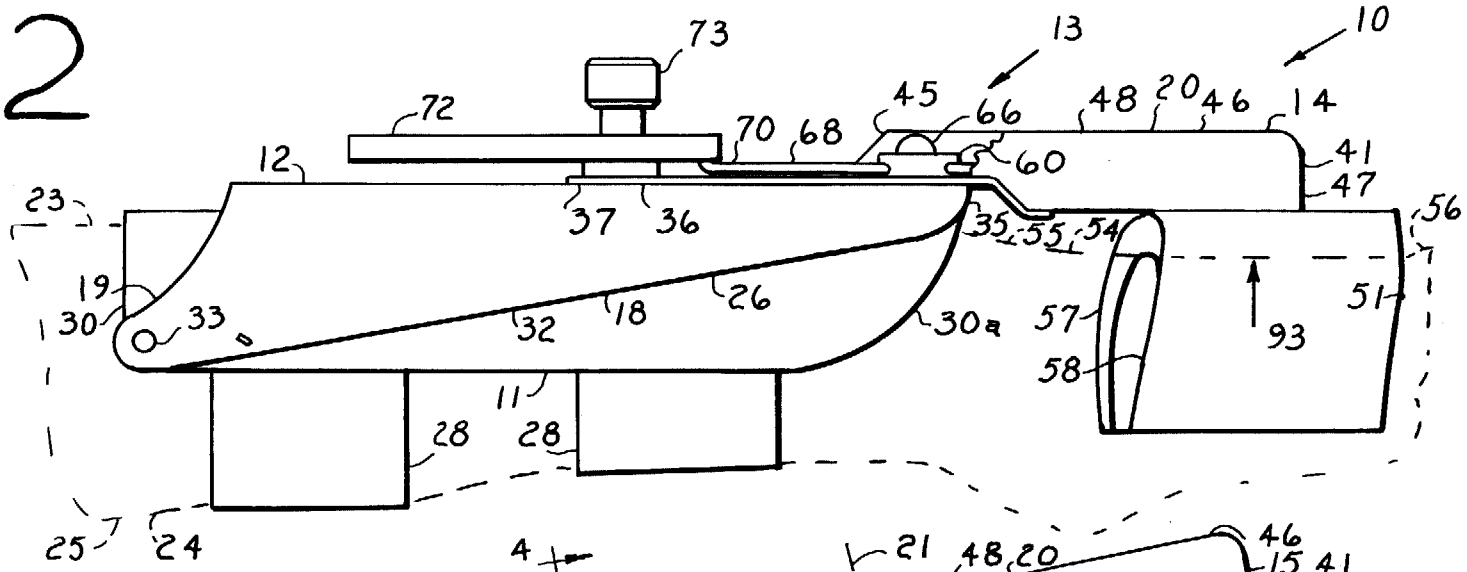
FIG. 2 is a side elevational view of the device shown in FIG. 1 and as attached to a golfer's leading arm, a fragment of which is shown in broken lines.

Reference is now made to the preferred embodiment seen in the drawings and wherein the training device is generally designated at 10. It includes a base plate 11, a pivot arm or member 12 which is pivotally connected to the base plate, and a releasable mechanism for retaining the pivot member 12 at a normal operating position 14 at which it overlies the base plate as shown in FIG. 2. When the mechanism 13 is released, the pivot member moves under the urgings of a pair of coil springs 16 into an offset position such as designated at 15 in FIG. 3.

The pivot member 12 in the preferred embodiment illustrated has a body portion 18 which at its proximal end 19 is pivotally connected to the base plate 11. Member 12 also has a distal end portion 20 which is mounted for pivotal movement with respect to the body portion about an axis which is designated at 21 in FIG. 3. This axis 21 is normal to the back of the hand when the device is properly attached to the forearm and the member 12 is at its normal operating position. The axis 21 under such circumstances is also coincident with the axis for pivotal movement of the hand which is normal to the back of the hand and extends through the wrist joint. At its end extremity, the distal end portion 20 of member 12 has a suitable section that is designed to engage the back of the golfer's hand when the member is at its normal operating position 14.

Figure 5:
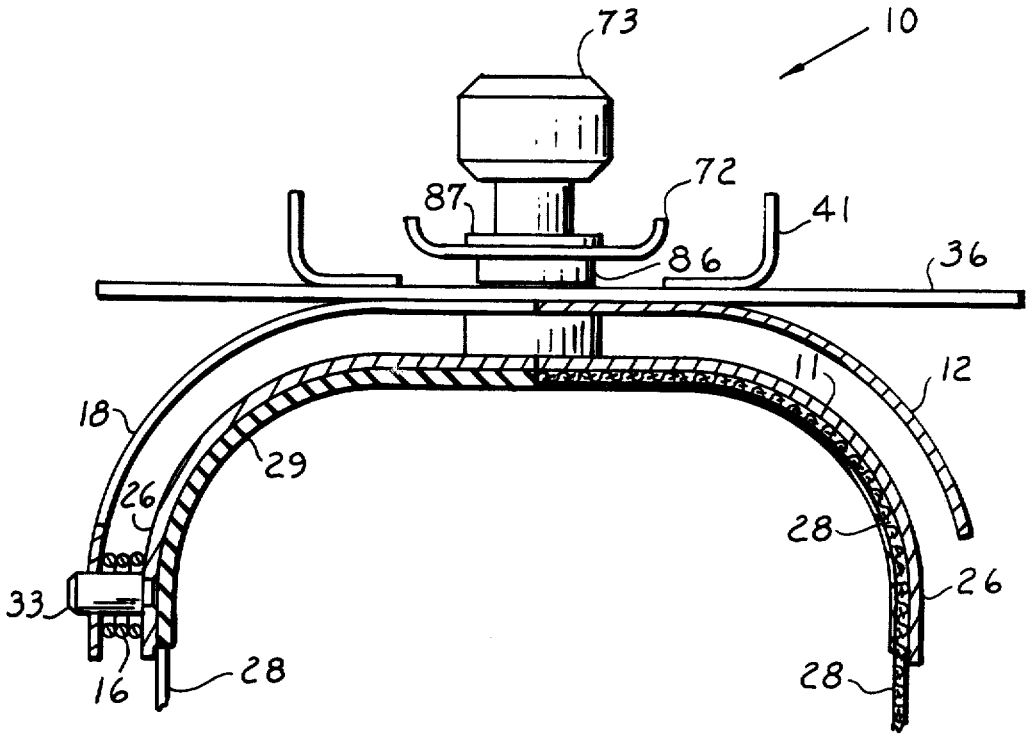
FIG. 5 is a transverse view at the proximal end of the pivot arm as taken along the Lines 5—5 of FIG. 1.
Figure 7A:
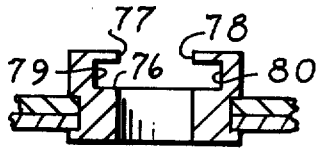
Figure 4:
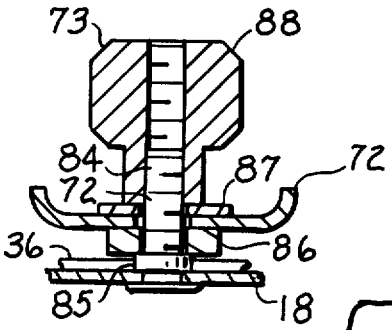
FIG. 4 is a sectional view through a clamping component of an adjustable arm retainer of the device and as seen along the Lines 4—4 of FIG. 3.

As seen in FIG. 5, the base plate 11 is generally arcuate in contour when viewed transversely and as thus shaped, snuggly fits on the back side 23 of the forearm part 24 of the golfer's leading arm 25. With this arrangement, the plate 11 is provided with a pair of opposite side portions 26. The base plate 11 is attached to the forearm 24 by means of a pair of straps 28. These straps are spaced apart and are secured to the underside 27 of the base plate by means of a suitable adhesive. Between the straps and at the opposite ends 30 and 31 of the base plate 11, the plate is provided with suitable padding 29 which again is attached to the plate underside 27 by suitable adhesive means.

Figures 1, 6, 7:
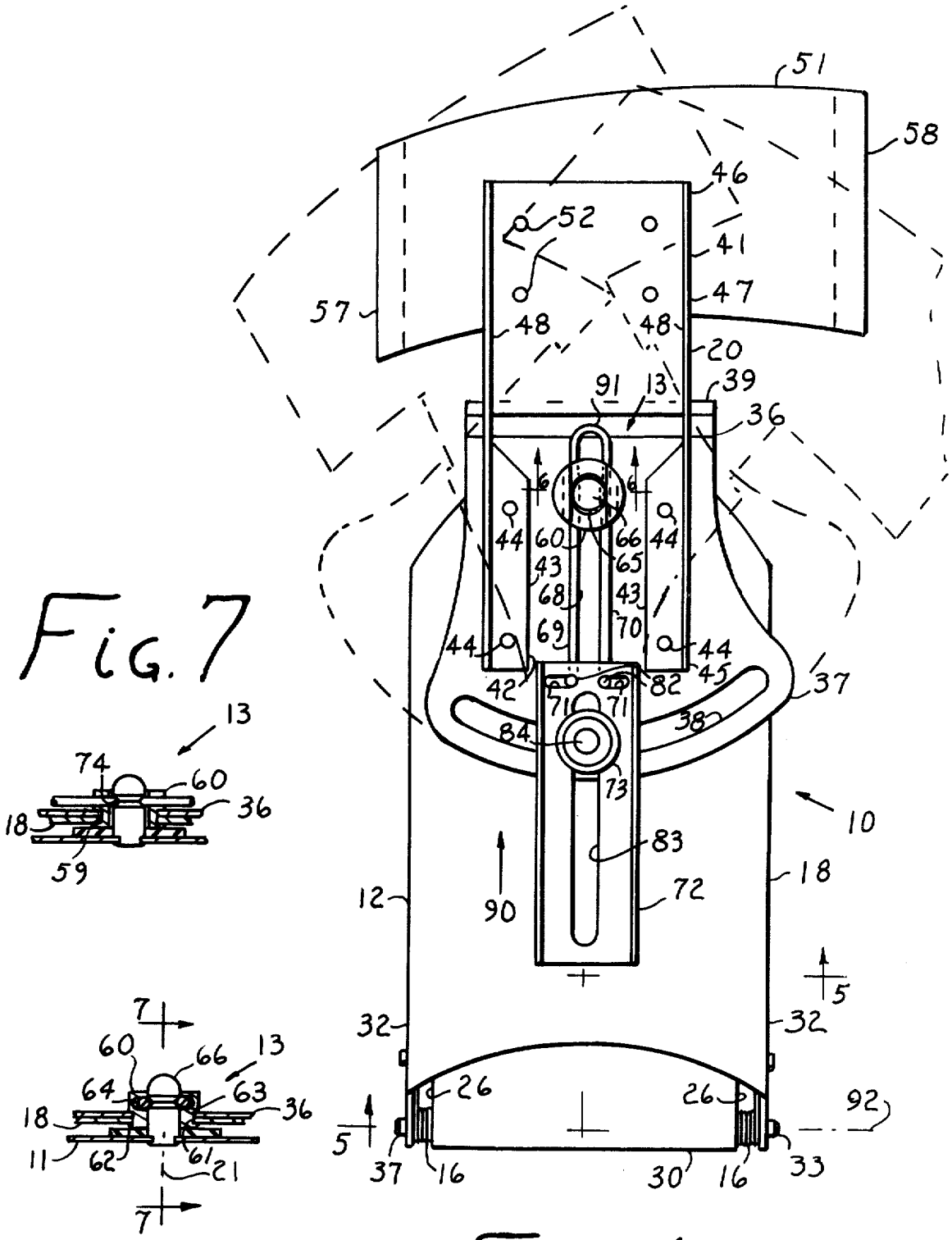
FIG. 1 is a plan view of a golfer's training device embodying the principles of the invention.
FIG. 6 is a sectional view through certain components of the arm retainer as seen along the Lines 6—6 of FIG. 1.
FIG. 7 is another view at right angles thereto as seen along the Lines 7—7 of FIG. 6.

The body portion 18 of the pivotal member 12 is also arcuately contoured, as seen in FIG. 5. This arrangement provides opposite sides 32 for the body and these sides 32 overlap the opposite sides 26 of the base plate 11 when the device is assembled and the arm component 12 is at the overlying position 14. This side overlapping arrangement facilitates the connection of the body portion 18 of component 12 to the end 30 of base plate 11 and where at the body portion 18 and base plate 11 are connected by means of aligned pivot pins 33 which are mounted on the adjacent sides 26 and 33 of the device components. Here the training device 10 is also equipped with the pair of coil springs 16 that urge the arm out of its overlying position 14 and toward its offset position 15 as illustrated by arrow 22. As best seen in FIG. 1, each of the springs 16 is coiled around one of the pivot pins 33 in the space between the adjacent sides 26 and 32 and in an arrangement where the opposite ends 34 of each spring are mounted in the adjacent sides of the respective components 11 and 18.

The distal end portion 20 of the pivotal member 12 includes a flat, planar section 36, an intermediate section 41, and an arcuate end section 51. Section 36 is equipped with a flaired inner end 37 that has an arcuate slot 38 so as to permit pivotal movement of the end portion and simultaneously accommodate the location of a fixed pin of a clamping device that will be subsequently described. The outer end 39 of the flat section 41 is bent downwardly to a position in front of the distal end 35 of the body portion 18 of member 12. Section 41 has an end cutout 42 and is appropriately bent at its sides to provide a pair of spaced apart rearwardly projecting angle shaped legs 43 which are fixed by rivets 44 to the flat section of the distal end portion 20 of the pivot arm member 12. At the outer end 46 of section 41, the section takes the form of a shallow channel 47 which rests on the outer end lip 40 of section 36 and projects forwardly thereof to accommodate the location of the arcuate section 51. The bent side arrangement of section 41 provides opposite side ribs 48 which tend to strengthen the structure.

The arcuate section 51 of the distal end portion 20 is connected to the underside of the channel portion 47 by means of rivets 52. This section 51 is arranged to engage the back 55 of the hand adjacent to the knuckles 56 and is arcuately shaped to provide opposite sides 57 and 58 that generally overlap the metacarpal bones of the index and little finger on the hand.

The component that serves to pivotally connect the distal end portion 20 to the body portion 18 of arm 12 is shown in the form of an annular pivot element 60 which is best seen in FIGS. 1, 6 and 7. Body 18 has a circular opening 61 and the flat section 36 also has another circular opening 63. These openings 61 and 63 are aligned in the assembly of the device 10 and the shank 59 of the pivot element 60 is arranged in the opening and thereafter provided with a flaired bottom end 62 that serves to trap the body portion and flat section between the shoulder 64 and flange-like end 62 in an arrangement such that the flat section 36 is rotatable with respect to the body portion 18 about the axis 21.

The mechanism 13 for retaining the arm 12 in its normal operating position 14 includes a pin 66 that is mounted upright at the outer end 31 of the base plate 11. Pin 66 is adapted and arranged for reception in the opening 65 of the annular pivot element 60 when the pivotal member 12 is in its normal operating position. Opening 65 is somewhat elliptical, as generally seen in FIG. 1, to accommodate reception and withdrawal of the pin 66 as the arm 12 moves into and out of its overlying position. In addition to pin 66, the retainer mechanism 13 includes an elongated member that is bent upon itself to provide a U-shaped, resilient element 68 that has a pair of spaced apart legs 69 and 70. These legs cooperate with the pin 66 in retaining the arm 12 in its normal operating position 14. At their ends, the legs 69 and 70 are upwardly bent for reception in a pair of lateral slots 71 at the front end of an elongated flat element 72. This element is clamped in place by a clamping component 73 of mechanism 13 and which will be subsequently described.

The upper end of pin 66 is hemispherical and provided with an annular peripheral groove or channel 74. When the arm 12 is moved into the base plate overlying position 14, the legs 69 and 70 of element 68 are resiliently deflected outwardly by the hemispherical head of the pin and thereafter come to rest in the channel 74 at the opposite sides of the pin 66 so as to retain the pivot arm in its normal operating position. The annular pivot element 60 has an upper end channel 76 with opposite side walls 77 and 78. These walls 77 and 78 are parallel and sufficiently spaced apart to snuggly accommodate the upper end of the pin 66 therebetween. Each wall 77 and 78 has a lateral groove 79 and 80 through which the respective legs 69 and 70 extend when the pin 66 is engaged in channel 74 by the legs. These grooves 79 and 80 confront each other and are confronted by channel 74 when the pivot arm 12 is in its normal operating position 14. Element 68 cooperates in retaining the pivot arm in its overlying position with respect to the base plate by engagement with pin 66 while in the channel 76 of pivot element 60. Grooves 79 and 80 are sufficiently deep enough to accommodate lateral movement of the legs 69 and 70. As such, when force is applied to the arm to deflect it away from plate 11, the legs 69 and 70 are forced out of the channel 74 in pin 66 and the pivot arm 12 is released for pivotal movement to an overlying position.

Figure 3:
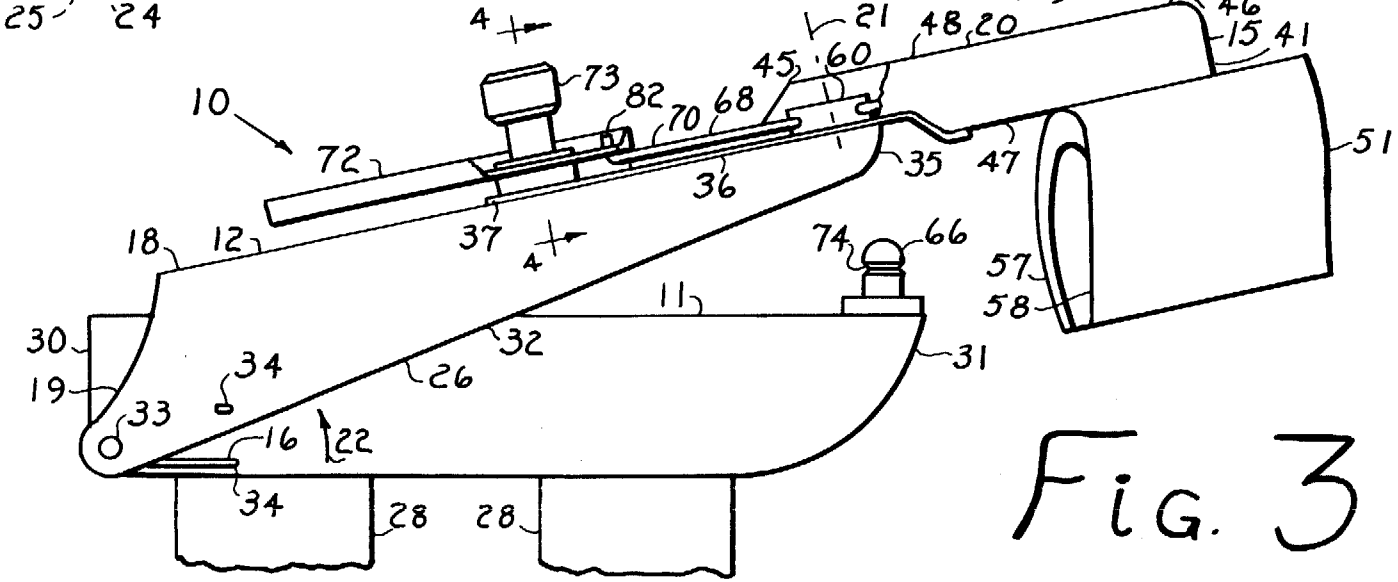
FIG. 3 is another side elevational view of the device shown in FIG. 2, the pivot arm or member being here shown in an offset position with respect to the base plate, certain parts being broken away.

The opposite ends 82 of the U-shaped element 68 are bent upright as seen in FIG. 3 and fit into the lateral slot 71 of the flat element 72. Element 72 has an elongated slot 83 and the clamping component 73 has an upright pin 84 which is fixed to the body portion 18 and extends upright through the slot 38 in the planar section 36 and also through the slot 83 in element 72. Pin 84 carries a washer 85 which is slightly thicker than the thickness dimension of section 36 and the clamping component includes an annular spacer 86 which rests on washer 85 at the bottom of element 72 as well as another washer 87 that is located at the top of element 72. Component 73 also includes an internally threaded knob 88 which fits on pin 84 and is adjustable to clamp section 72 between spacer 86 and washer 87 to retain the element 72 in place.

To adjust the force deterring pivotal movement of the pivot arm 12 out of its normal operating position 14, the knob 88 of the clamping component 73 is manipulated to release element 72 from its clamped position between elements 86 and 87. Thereafter, by manipulating element 72 as in the direction of arrow 90, element 68 is also moved to a position at which the return bend 91 is further away from pin 66. This adjustment diminishes the amount of pressure required to overcome the forces retaining the components in the normal operating position 14 whereas movement of the element to draw the return bend 91 closer to pin 66 greatly increases the pressure required to overcome the forces deterrent to break away of the component from the normal operating position.

In practice and assuming the golfer to be right handed so that the leading arm is his left arm whereas his power arm is his right arm, the golfer attaches the training device 10 to forearm 24 of his left arm 25 and in an arrangement such that the axis of pin 66 basically extends through the wrist joint while the arcuate section 51 engages the back of the hand just behind the knuckles 56. As thus mounted on the golfer's arm, the pivot member 12 is placed in the normal operating position 14 and in which position the legs 69 and 70 of element 68 engages pin 66 in channel 74, the knob of clamping component 73 under such circumstances being screwed down so as to clamp element 72 and thus prevent longitudinal movement of the U-shaped element 68 of mechanism 13.

With the device 10 thus attached to the golfer's leading arm, the distal end portion 20 of the pivot member 12 can pivot about axis 21 as the left hand is moved about the perpendicular axis through the knuckle joints. Accordingly, as the golfer starts his back swing, there comes a point at which the hand and thus the distal end portion 20 of the training device 10 pivot about axis 21 while the hand of the right arm becomes ultimately cocked at the top of the back swing. Thereafter during the down swing of the power stroke, the right hand starts to break from its cocked position shortly before the club head addresses the ball and as this happens, the left hand also starts to pivot about the axis 21 and during the follow through starts to bend about the wrist axis parallel to the axis 92 of pivotal movement for arm 12. As this happens, pressure as in the direction of arrow 93 is applied to section 51 and the legs 69 and 70 of element 68 are forced out of the channel 74 of pin 66 and thus to release the arm for pivotal movement to an offset position. During the down stroke, the raising the arm 12 at position 14 is such as to function as a pressure deterrent against backward movement of the hand while nevertheless permitting such movement if the forces retaining the arm in the plate overlying position are overcome.

As the player practices his golf swing with the device, he will shortly become aware of the position during the power stroke at which he has a tendency to pivot the leading hand backwardly in a direction to release the arm 12 and accordingly will, if the need arises, gradually adjust his swing and wrist movement to the proper point in time of the power swing and to the end that the device 10 is no longer needed for corrective purposes. If the golfer, of course, desires to maximize or minimize the forces deterrent to pivotal movement of the arm, he may simply, of course, adjust the retainer mechanism by manipulating the knob of the clamping component 73 and appropriately adjusting the relationship of element 72 to pin 66.

While only a certain preferred embodiment of this invention has been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. A golfer's training device comprising a base plate, means for fastening the base plate to the golfer's forearm, a pivot arm pivotally connected to the base plate for pivotal movement between a base plate overlying position and a pivotally offset position, said pivot arm having a distal end portion which is arranged to engage the back of the golfer's hand at its plate overlying position, and means retaining said pivot arm at its plate overlying position and responding at a predetermined hand pressure exerted against said distal end portion to release said pivot arm for movement to its offset position.

2. A golfer's training device in accord with claim 1 wherein said pivot arm has a body portion, and means pivotally connecting said distal end portion to said body portion for movement about an axis which, at the overlying position, is generally normal to the back of the golfer's hand.

3. A golfer's training device in accord with claim 2 comprising adjustable means mounted on the body and connected to the retaining means, said adjustable means being adjustable to determine the hand pressure for response of the retaining means.

4. A golfer's training device in accord with claim 1 comprising means connected to the retaining means and being adjustable to determine the hand pressure for response of the retaining means.

5. A golfer's training device comprising a base plate having opposite ends, means for fastening the base plate to the golfer's forearm, a pivot arm pivotally connected to the base plate at one of said opposite ends for pivotal movement between a base plate overlying position and a pivotally offset position, said pivot arm having a distal end portion which is arranged to engage the back of the golfer's hand at its plate overlying position, releasable means retaining said pivot arm at its plate overlying position, and means urging the pivot arm toward its offset position, said retaining means comprising a pin mounted upright on the base plate at the other of its opposite ends, and elongated means mounted on said pivot arm and engaging said pin at the base plate overlying position of the pivot arm, said elongated means being disengagable from said pin at a predetermined hand pressure exerted against said distal end portion to release said pivot arm for pivotal movement to its offset position.

6. A golfer's training device in accord with claim 5 wherein said pivot arm has a body portion, and pivot means connecting said distal end portion to said body portion for pivotal movement about an axis which, at the overlying position, is generally coaxial to that of said pin.

7. A golfer's training device in accord with claim 6 wherein said pivot means has an opening through which said pin extends at the plate overlying position for the pivot arm, and confronting grooves which are located at opposite sides of said opening, said pin having a channel that confronts said confronting grooves at the plate overlying position for the pivot arm, and said elongated means being U-shaped and having a pair of legs that are arranged to engage said pivot means within the respective grooves thereof and further arranged at the overlying position for the pivot arm to engage the pin within said channel.

8. A golfer's training device in accord with claim 7 comprising adjustable means connected to said elongated means and being movable to adjustably determine the hand pressure for release of said pivot arm.

* * * * *